US007287350B2

(12) United States Patent
Fast et al.

(10) Patent No.: US 7,287,350 B2
(45) Date of Patent: Oct. 30, 2007

(54) FIXED ANGLE ESL LABEL HOLDER WITH FLEX GRIP AND MOISTURE SEAL

(76) Inventors: Jacob Fast, 8738 Via Ancho, Boca Raton, FL (US) 33433; Michael G. Lowry, 110 Summer Storm Pl., The Woodlands, TX (US) 77381

( * ) Notice: Subject to any disclaimer, the term of this patent is extended or adjusted under 35 U.S.C. 154(b) by 6 days.

(21) Appl. No.: 11/245,441

(22) Filed: Oct. 7, 2005

(65) Prior Publication Data

US 2006/0143962 A1 Jul. 6, 2006

Related U.S. Application Data

(60) Provisional application No. 60/616,845, filed on Oct. 8, 2004.

(51) Int. Cl.

| | |
|---|---|
| ***G09F 3/00*** | (2006.01) |
| ***G09F 3/18*** | (2006.01) |
| ***A47B 5/00*** | (2006.01) |
| ***B32B 7/00*** | (2006.01) |

(52) U.S. Cl. ..... 40/642.02; 40/642.01; 40/308; 40/661.03; 211/183; 211/184; 428/122

(58) Field of Classification Search ..... 40/642.02; 24/545, 546; 428/122

See application file for complete search history.

(56) References Cited

U.S. PATENT DOCUMENTS

| | | | | |
|---|---|---|---|---|
| 5,572,822 | A * | 11/1996 | Lynch et al. | 40/642.02 |
| 6,142,322 | A * | 11/2000 | Smith et al. | 211/183 |
| 6,534,147 | B2 * | 3/2003 | Gopalan | 428/122 |

* cited by examiner

*Primary Examiner*—Lesley D. Morris
*Assistant Examiner*—Syed A Islam
(74) *Attorney, Agent, or Firm*—Jacobson Holman PLLC

(57) ABSTRACT

An electronic shelf label (ESL) holder, including an attachment member portion to be secured to a supporting surface, such as a C-channel, a holder member with protrusions for removably receiving and supporting the ESLs and, optionally, a cover member pivotally carried by the holder member to overly and protect the ESLs. The holder member includes a lip extending from at least one of the top or bottom fingers of the holder formed of flexible PVC material that is flexible relative to the remaining portion of the holder and is compressible for providing a tight fit of the ESL to the holder. The flexible lip is utilized in combination with a backing member which, in one embodiment, is a flexible PVC bead that extends along the length of the holder and, in a second embodiment, includes a relatively broad or wide pad of flexible PVC material that further provides a seal against the battery or other electronics of the ESL.

10 Claims, 4 Drawing Sheets

FIXED ANGLE ESL LABEL HOLDER WITH FLEX GRIP AND MOISTURE SEAL

This application claims the benefit of, and priority from, provisional application Ser. No. 60/616,845 filed Oct. 8, 2004.

BACKGROUND OF THE INVENTION

1. Field of the Invention

This invention relates to label holders and relates more particularly to holders for electronic shelf label ("ESL") devices generally mounted at the front of a merchandise shelf in a retail establishment to provide information regarding products carried by the shelf.

2. Description of Related Art

Consumer-oriented product information labels are commonly found in supermarkets, drug stores, and the like and provide purchasers with the unit price, promotional and nutritional information, and the like and, also, commonly include bar codes or other inventory control information for the use of the store personnel. Such information may be carried on paper or plastic labels secured directly to the side of a shelf unit or the front edge of a merchandise shelf, but the use of adhesively-backed labels has obvious disadvantages in the constantly changing commercial environment found in today's marketplace. More often, the front edge of the merchandise shelf is provided with an integral C-channel or the like which is adapted to either carry the labels directly or, alternatively, to carry plastic holders which are adapted to removably receive and display the labels in a well known manner. Label holders adapted for use in various environments will be seen in commonly assigned U.S. Pat. Nos. 4,625,441, 4,716,669, 5,458,307, 5,488,793, 5,515,632, 5,678,699, 5,682,698, 5,899,011 and 6,163,996. These patents are cited merely as exemplary to illustrate the many and varied forms such devices can take.

More recently, in place of, or in addition to, such paper or plastic information containing labels, electronic information carriers have been employed. Electronic shelf labels (ESLs) are generally integrated with the in-store processor (ISP) or a free-standing controller that communicates with file information supporting the store's point-of-sale system. The ESL system may include low-voltage communication electronics or communication base stations (CBS) located in store ceilings away from the store operations. The ESLs are positioned throughout the store to identify an item's retail price and other information of interest to the consumer or for use by the store's inventory system.

Price changes may be initiated through the store's controller which updates item price files. This information, which has an association to a particular product identified by item number or UPC code, is communicated to the CBS in the ceiling and transmitted via a high frequency radio signal to the corresponding ESL.

The ESLs are programmed with differing addresses that are also associated with the item number or UPC code of the product they represent. Once the addressed device is found, the label display changes and reflects an acknowledgment back to the CBS to confirm that the transmission was received and enacted. This acknowledgment is then communicated back to the ISP to complete the transaction.

These systems, such as produced by NCR under its DecisioNet™ trademark, allow the ESLs to be independent of wires and cables below the ceiling, which reduces installation time and cost. Since there are no wires or cables required from the ceiling down, the label is free to be positioned anywhere. When store shelf resets occur, ESLs move easily with the shelves.

These ESL units, however, much like paper labels, require a carrier device to facilitate supporting them at selected locations, usually on the front of a store merchandise shelf. It is ESL carriers of this type with which the instant invention is concerned.

One such ESL carrier is described in commonly assigned, copending patent application Ser. No. 10/448,049 filed on May 30, 2004, entitled Label Holder for Electronic Labeling Devices, published Dec. 30, 2004 under No. 20040262470, incorporated by reference herein. The ESL holder in that application includes various mounting arrangements for orienting the ESL at different levels, i.e., straight, upward or downward, depending upon the particular shelf that the label holder is mounted upon. As such, the mounting arrangements have some complexity and attendant costs. See, also, U.S. Pat. No. 6,119,990. Fixed angle ESL holders are simpler and less expensive.

Because ESLs require a source of power, such as a battery, when an ESL is mounted in an environment that is subjected to moisture, such as adjacent refrigeration units, moisture can seep in through the battery cover and adversely affect the power source to the ESL. Thus, a need has arisen for some mechanism to prevent battery failure when used in moist environments.

SUMMARY OF THE INVENTION

It is an object of the present invention to provide a fixed angle ESL holder particularly adapted for supporting ESLs at the front edge of a merchandise shelf to enable one or more ESLs to be positioned and repositioned in a simple and inexpensive manner.

It is a further object of the present invention to provide an ESL holder that allows for easy insertion of the ESL to the holder, yet maintain a tight grip on the ESL holder and prevent slippage or movement of the ESL as the holder may be impacted through use.

Still further, it is an object of the present invention to provide an ESL label holder that may be used with ESLs in moist environments and to seal the battery opening to prevent moisture from seeping therethrough.

Other and further objects, features and advantages of the invention will become apparent from the ensuing description and claims taken in conjunction with the attached drawings.

BRIEF DESCRIPTION OF THE DRAWINGS

These and other objects, features and many of the attendant advantages of the invention will be better understood upon a reading of the following detailed description when considered in connection with the accompanying drawings wherein:

FIG. 3(*b*) is a back perspective view of a typical ESL device;

FIG. 3(*c*) is a close up view of the back perspective view of a typical ESL device;

Like reference characters refer to like parts throughout the several views of the drawings.

DETAILED DESCRIPTION OF THE PREFERRED EMBODIMENTS

Figure 1:
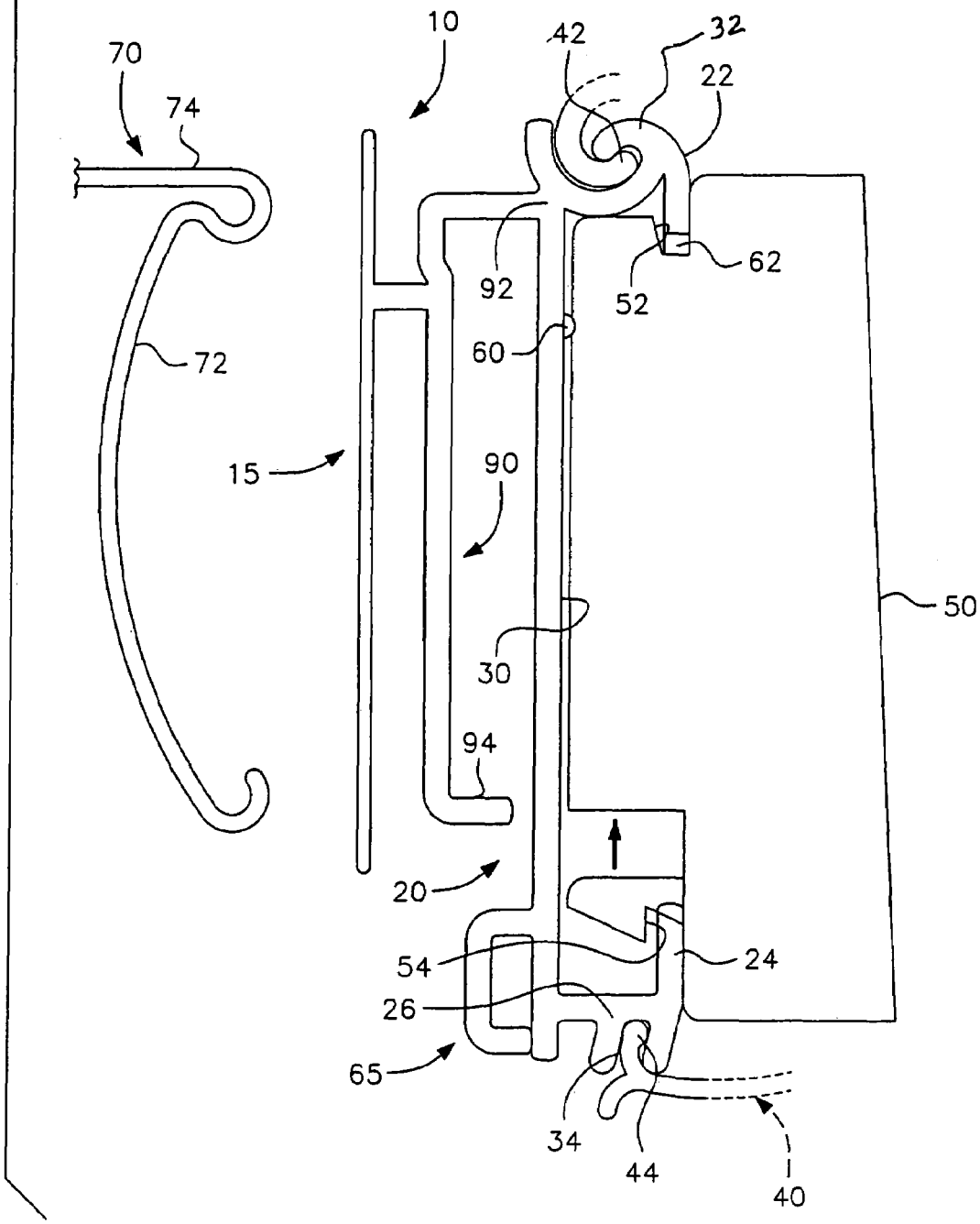
FIG. 1 is a side cross-section or end view of the ESL holder of the present invention with a typical ESL mounted therein and positioned adjacent a shelf.

In describing preferred embodiments of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
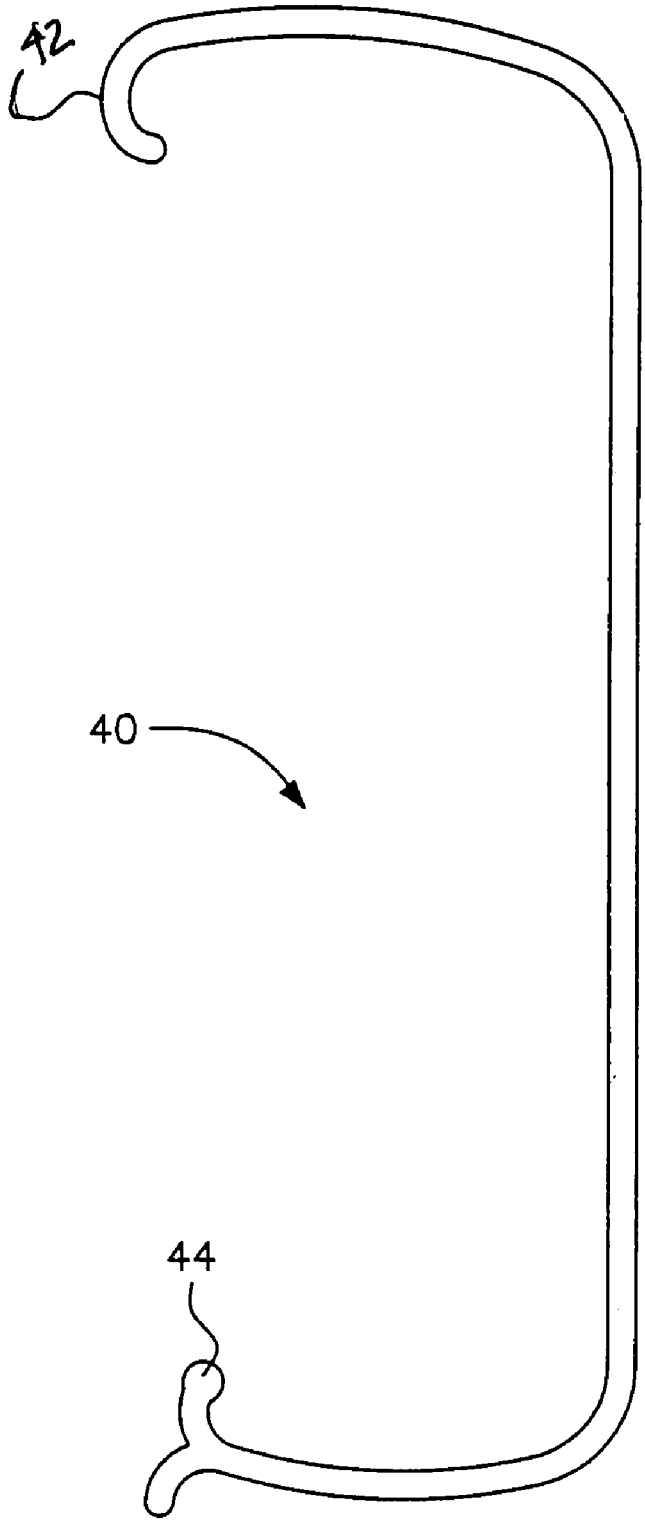
FIG. 2 is a side cross-section or end view of a cover member for the ESL holder of FIG. 1.
Figure 3A:
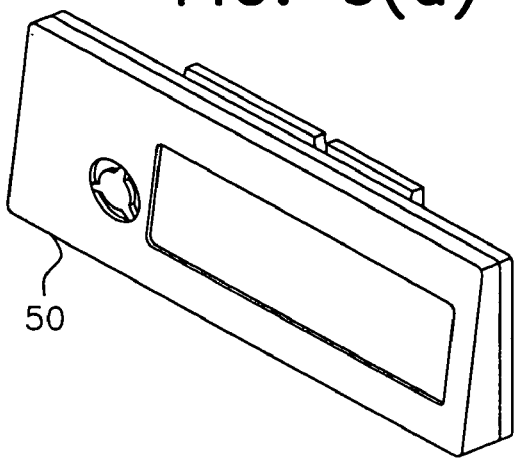
FIG. 3(*a*) is a front perspective view of a typical ESL device.
Figure 3B:
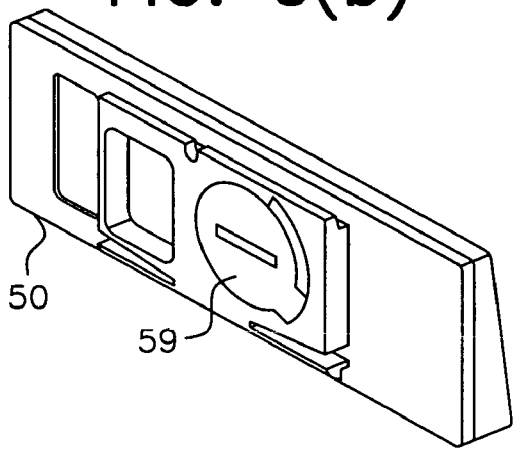
Figure 3C:
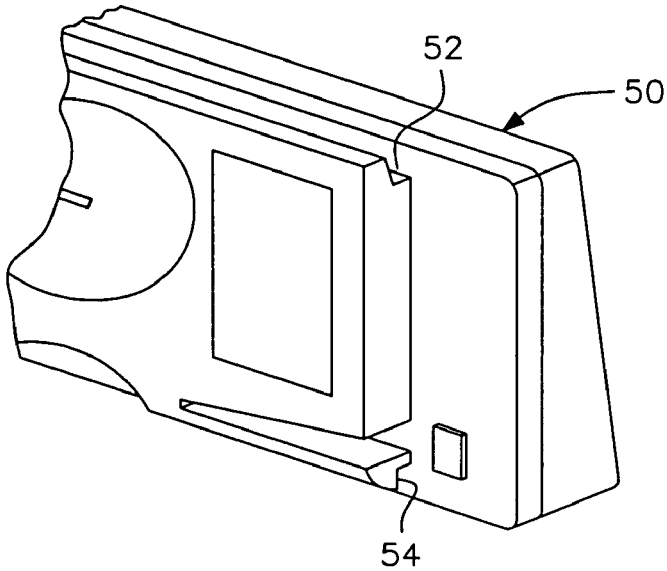

Referring now to the drawings, and more particularly to FIGS. 1-3, one embodiment of an electronic shelf label (ESL) carrier according to this invention is designated generally by the reference numeral 10 and is comprised of a holder member 20 adapted to removably receive and support one or more ESL devices as discussed below, the holder member 20 including an attachment member 15, and a cover member 40. Each of these elements are formed in any conventional manner, as by extrusion, of any suitable polymeric material, preferably PVC. Those with ordinary skill in the art can readily select the appropriate manufacturing method and material which are not critical to the instant inventive concepts.

The holder member 20 is preferably formed of a relatively rigid opaque plastic material and is sufficiently robust to receive and carry one or more ESL devices shown schematically at 50, the specific construction of which is also not a part of this invention. Regardless of the design of the ESL device 50, it will ordinarily have protruding portions defining slots as shown at 52, 54 and the holder member 20 will incorporate complementary fingers or the like 22, 24 which together with the back 30, secure the ESL device 50 therewithin.

It is to be understood that the design of the ESL device will dictate the precise configuration of the interior of the holder member 20 which will include complementary fingers or undercuts, as necessary, to enable the ESL devices to be snapped into engagement with the holder member 20, to position the ESLs at a point on the shelf front juxtaposed to the merchandise to which they relate.

The cover member 40 is preferably extruded in a clear polycarbonate or other such material resistant to damage when struck by objects such as shopping carts or the like, and is adapted to be snapped onto the holder member 20 across its length. More specifically, the holder member 20 is provided with a depending pivot element 32 which engages with a C-shaped element 42 at the upper end of the cover member 40 to permit the cover member 40 to be hingedly rotated about the pivot member 32 to access the interior of the holder member 20 to remove, replace, service or move an ESL device 50 therewithin. While the cover member 40 can be opened and closed at will, and normally remains with the holder member 20 to avoid the need for totally removing the cover member while servicing an ESL, the cover member 40 is preferably not integral with the holder member 20 so that the cover member 40 can be independently replaced if it is damaged, avoiding the need to replace the entire carrier device 10.

The lower end of the cover member 40 includes a finger or hook 44 which can be snapped into a detent 34 in the bottom 26 of the holder member 20. This design is not only simple and inexpensive to manufacture, but protects the ESL device from physical damage and, also, limits the entry of dust or other extraneous undesirable material from accessing the interior of the holder member 20.

Under some circumstances, the cover member 40 can be dispensed with and is not required in use. The cover member 40 per se is not a necessary component of the present invention.

The holder 10 is shown adjacent to a shelf 70 comprising a substantially vertically extending front edge 72, and a generally horizontally extending support portion 74 adapted to carry merchandise (not shown) for display. Shelves of this general nature are commonly used in supermarkets and the like. For use with such shelves, the attachment element 15 of the ESL carrier 10 shown in FIG. 1 is an H-back element as is well-known in the art. Other attachment elements may be readily integrated into the carrier 10 of this invention without departing from the instant inventive concepts.

Additionally, a sign holder or grip designated generally by the reference numeral 65 can be provided at the bottom of the ESL holder member 20 to support a promotional sign or flag or the like (not shown).

The length and height of an individual section of the ESL holder or carrier may vary within the scope of this invention. For most applications, however, the device is dimensioned to reflect the size of the ESL and marketed in four foot lengths for attachment to the front of a merchandise shelf.

A small section or rib of flexible polymer, such as polyvinyl chloride, for example, is shown at 60 and can be provided on the inside surface of the rear wall 30 of the holder member 20 to interact with the rear surface of the ESL device and preclude the ESL device from sliding horizontally within the holder 20.

The rib 60 coacts with an upper finger 22 which includes a flexible lip portion 62 oriented downwardly. The lip portion 62 is of relatively soft PVC that is flexible, compressible and generally of the same material as the rib or bead 60. As shown in FIG. 1, the flexible bead 60 is oriented at a 90° degree angle with the flexible lip 62 to assist in providing a secure attachment of the ESL. The flexible lip 62 is readily angularly distortable and makes insertion of the ESL relatively easy, but, when the ESL is positioned therewithin, the compressive force is high, thus making accidental removal relatively difficult.

Orienting the two pieces of flexible PVC to exert pressure on the ESL in two directions at 90° degrees from each other, makes for a secure retaining mechanism than pressure from only one direction when only one piece of flexible PVC is used, typically on the back of the holder. In addition, the flexible PVC, both on the top lip 62 and ridge or bead 60 at the back of the holder, impedes movement in a sliding direction, i.e., into or out of the page as shown in FIG. 1. This keeps the ESL firmly in place.

Attachment of the ESL to the holder first requires the top slot 52 of the ESL to be angled and compressed against the PVC lip 62 and thereafter the ESL is pivoted in a downward, counterclockwise direction, as shown in FIG. 1, to snap the bottom lip 24 into the spring clip 56 recess 54 of the ESL. The ESL 50 as shown includes a spring clip 56 pivotable upwardly and downwardly. As set forth above, the compressibility of the top lip 62 exerts a downward pressure and a taut interengagement between the spring clip recess portion 54 and the bottom finger 24, along with a compression at 90° degrees with the back flexible PVC rib 60 to provide for a tight connection.

The ESL holder includes a back planar member 30 which, at its upper end, includes a C-shaped element 42 and, at its lower end 26, includes a detent 34 to receive the cover member finger 44. Extending from the rear portion of the back member 30 is a support element 90 which, as shown, is integrally connected and formed with the back element 30 at one end only, here at the upper end 92. The bottom portion 94 of the support member 90 is oriented 90° degrees in a direction toward the back 30 and is spaced therefrom to provide a stop to limit angular movement of the back plane 30 when the ESL is secured thereto. This orients the ESL in a generally horizontal direction.

Figure 4:
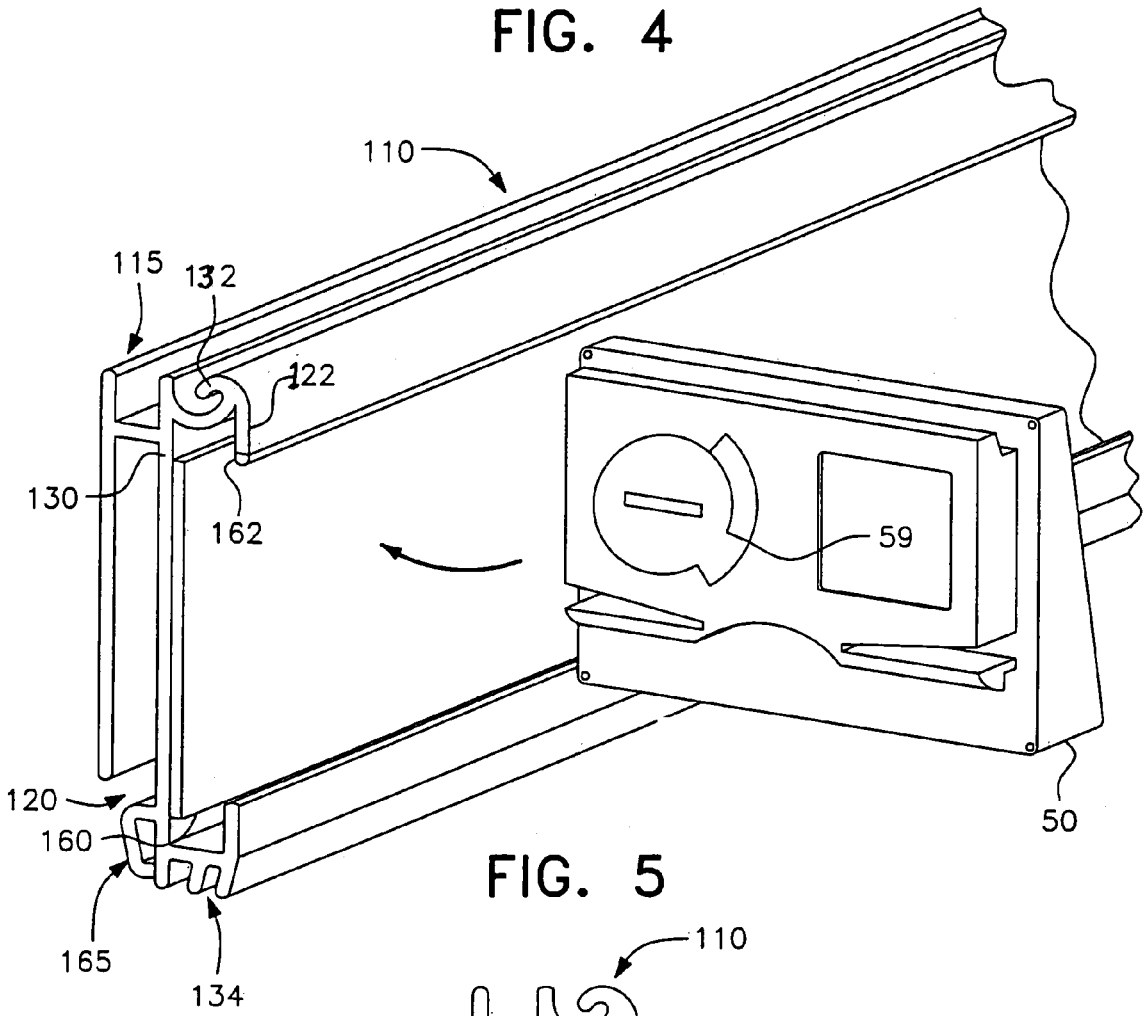
FIG. 4 is a perspective view of a second embodiment of the present invention showing the moisture seal associated with the ESL holder.
Figure 5:
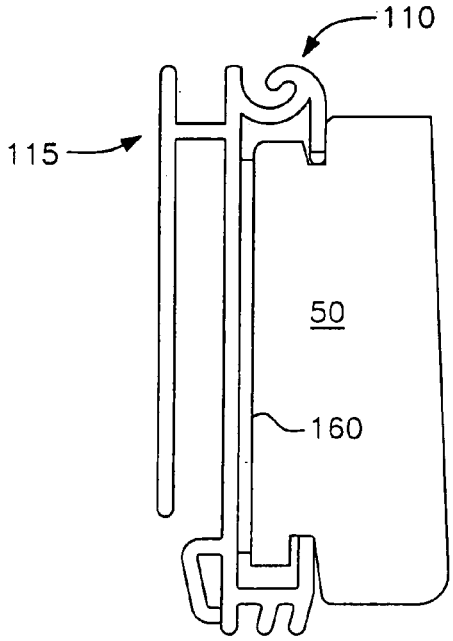
FIG. 5 is an end or cross-section view of the ESL holder of FIG. 4.

FIGS. 4 and 5 depict a second embodiment of the present invention that is substantially identical to the embodiment of FIGS. 1 and 2 with similar numerals in the "100" series. Instead of the flexible PVC bead or ridge 60, a flexible PVC pad 160 is coextruded to the PVC back 130 and aligned along the back to overlay a battery cover location 59 on the rear of the ESL 50. The flexible lip 162 is also included in this embodiment and the flexible PVC pad 160 provides an insulating moisture seal to minimize seepage of fluid through the battery cover 59 into the interior of the ESL 50, thus damaging the battery. The flexible PVC pad 160 also assists in firm retention of the ESL 50 because of the reactive force between the pad 160 and the back of the ESL and, in conjunction with the flexible lip 162, minimizes movement in a sideways direction. It should also be apparent that the flexibility of the pad assists in absorbing forces directed into the back plane of the holder. The flexible pad or band 162 protects against air and liquid moisture.

The holder back plane element 130 is shown directly and integrally connected with the attachment element, i.e., the H-back 115. However, a separate support element, such as element 90 in FIG. 1, can be utilized.

It should be appreciated that there are a variety of embodiments or alterations that can be made to the overall system without departing from the inventive concepts. For example, numerous types of mounting elements, other than the H-back configuration, could be utilized. Such variety of mounting elements are well known in the art. Further, the orientation of the cover to the holder member is shown with the C-shaped section 42 at the top and the detent 34 on the bottom. This could be reversed. Moreover, depending upon the exact construction of the ESL, variations in the protruding elements extending from the back of the ESL holder may be utilized. The important features of the FIG. 1 embodiment of the present invention are the use of a flexible PVC bead 60 in combination with the flexible lip 62 to provide for a tight engagement of the ESL to the holder and to prevent slippage or sliding of the ESL along the length of the holder. The flexible lip 62 could extend upward from the bottom.

Further, in the moisture pad embodiment of FIGS. 4 and 5, the significant inventive features include the flexible lip 162, in combination with a relatively broad, i.e., wide, moisture pad 160 that overlies the battery cover 59 to prevent air and/or liquid moisture from seepage therethrough. This also assists in a tight connection of the ESL to the holder and minimizes slippage or sliding along the length of the holder as with the previous embodiment.

The foregoing descriptions and drawings should be considered as illustrative only of the principles of the invention. Numerous applications of the present invention will readily occur to those skilled in the art. Therefore, it is not desired to limit the invention to the preferred embodiments or the exact construction and operation shown and described. Rather, all suitable modifications and equivalents may be resorted to, falling within the scope of the invention.

What is claimed is:

1. An electronic shelf label ("ESL") carrier including an elongated ESL holder for holding an ESL and an attachment member for attaching the ESL carrier to a merchandise shelf, said holder including a substantially planar wall and at least one gripping finger spaced from, and substantially parallel to, said wall and formed integral therewith, said attachment member integrally formed with said planar wall, said planar wall having a flexible, compressible engagement member extending in a direction substantially perpendicular from said wall in a direction toward said gripping finger, said gripping finger including a flexible, compressible lip extending therefrom to form a free end of said gripping finger, substantially parallel with said planar wall and substantially perpendicular to the direction of the engagement member, each of said engagement member and lip formed of a material that is compressible relative to the compressibility of the material of said wall and gripping finger, and wherein said wall and said gripping finger are of plastic material having a rigidity greater than that of said engagement member and lip, wherein said ESL device is engagable and retainable between said engagement member and said lip of said gripping finger by compressive forces acting thereon in directions substantially 90° apart.

2. The ESL carrier of claim 1, wherein said engagement member is a flexible, compressible bead of substantially semicircular cross-section having a length extending the length of said holder, said bead providing a reactive force against the ESL.

3. The ESL carrier of claim 1, wherein said engagement member is a flexible, compressible pad providing a reactive force against the ESL.

4. The ESL carrier of claim 3, wherein said pad interacts with said ESL device to provide substantially moisture-proof contact therewith.

5. The ESL carrier of claim 1, wherein said gripping finger is integral with said planar wall adjacent an upper portion of said planar wall.

6. The ESL carrier of claim 1, wherein said holder includes a pair of gripping fingers, at least one of which includes said flexible, compressible lip.

7. The ESL carrier of claim 1, further comprising a cover member that is removably attachable to said holder to cover the ESL when said ESL is held by said holder.

8. The ESL carrier of claim 1, wherein said holder is formed of opaque plastic.

9. The ESL carrier of claim 1, wherein said holder is elongated and has a length substantially greater than its height or width.

10. The ESL carrier of claim 9, wherein said holder length is approximately four feet.

* * * * *